US005525413A

United States Patent [19]

Daurer et al.

[11] Patent Number: 5,525,413

[45] Date of Patent: Jun. 11, 1996

[54] INDUSTRIAL ROOFING FABRIC

[75] Inventors: Mark D. Daurer, Greenville; John M. Whispell, Fountain Inn, both of S.C.

[73] Assignee: Milliken Research Corporation, Spartanburg, S.C.

[21] Appl. No.: 309,582

[22] Filed: Sep. 21, 1994

[51] Int. Cl.[6] ..... B23B 7/00

[52] U.S. Cl. ..... 428/247; 428/251; 428/252; 428/255; 428/257; 428/272; 428/273

[58] Field of Search ..... 428/255, 257, 428/262, 269, 247, 251, 252, 272, 273

[56] References Cited

U.S. PATENT DOCUMENTS 4,452,850 6/1984 Even et al. ..... 428/252

*Primary Examiner*—Christopher W. Raimund
*Attorney, Agent, or Firm*—Terry T. Moyer; Earle R. Marden

[57] ABSTRACT

A roofing membrane fabric having a PVC outer coating with a triaxially wound non woven scrim substrate inside thereof to provide rigidity and strength thereto. The selvage areas of the substrate having an increased number of warp yarns in spaced groups to provide an area for the attachment of the fabric to a roof through the use of roofing tacks inserted through the selvage areas of the fabric.

3 Claims, 2 Drawing Sheets

INDUSTRIAL ROOFING FABRIC

This invention relates to a new and improved roofing fabric which incorporates a novel substrate which allows the roofing fabric to be securely positioned on a roof and which is very flexible for mounting but has sufficient strength to provide the necessary service life for use as industrial roofing.

Prior to this invention it was difficult to find a thin, flexible material for industrial roofing which would pass the various building codes, provide the necessary service life required for such roofs and which would remain securely fastened to the roof under severe adverse wind and rain conditions.

Therefore it is an object of the invention to provide a roofing material for flat industrial roofs which will withstand severe weather conditions for an extended period of time.

Other objects and advantages of the invention will become readily apparent as the specification proceeds to describe the invention with reference to the accompanying drawings, in which.

Figure 3:
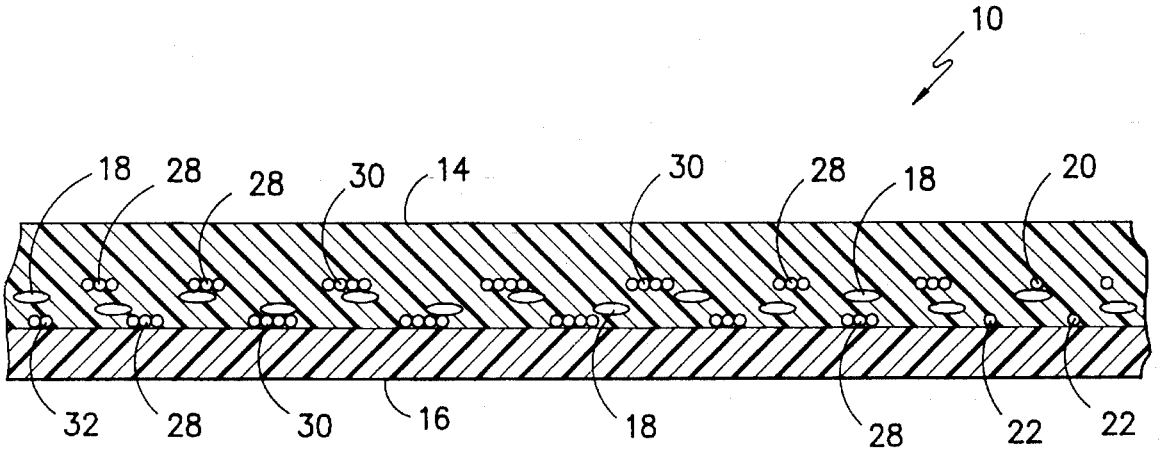
FIG. 3 is a partial section view of the new roofing fabric with the substrate of FIGS. 1 and 2 therein.

In the manufacturing of industrial roofing material for flat roofs it is desired to have a thin, flexible material which can be easily rolled out and tacked down and which will provide the desired protection for a number of years without tearing and/or rotting. Various states and organizations have enacted building code provisions which the roofing material must meet or exceed before it can be used for industrial roofs. The fabric 10 shown in FIG. 3 conforms to the necessary codes of the various organizations and states.

The new and improved roofing material 10 basically consists of the substrate 12 and the polyvinyl chloride (PVC) film or coatings 14 and 16, respectively on the top and bottom of the substrate 12 which adhere to one another in the interstices of the substrate. To provide good adhesion the polyester yarns of the substrates are coated with a thermoplastic coating such as plastisol polyvinyl chloride, polyethylene, styrene Budadiene rubber, etc. which is compatible with the PVC film or coatings 14 and 16 to enhance the strength of the roofing material 10 against ripping, tearing or delamination.

The substrate 12 is preferably composed of fully drawn polyester continuous filament yarns but other yarns such as nylon, fiberglass or combinations thereof can be used if desired. The construction of the substrate 12 is commonly referred to as a triaxial scrim fabric made on a tridirectional scrim machine with 1500 denier fill yarn 18 wound around a 1000 denier selvage yarn (not shown) in a manner generally disclosed in U.S. Pat. No. 3,422,511 or U.S. Pat. No. 4,242,779. Looking at FIG. 1 it can be seen that the fill yarn 18 is located between the 1000 denier warp yarns 20 and 22 with the warp yarns 20 being located on top of the fill yarns 18 and the warp yarns 22 located below. As mentioned before, all of the yarns 18, 20, 22 and the selvage yarns are preferably fully drawn high tenacity (4 grams or greater/denier) polyester continuous filament yarns.

Figure 1:
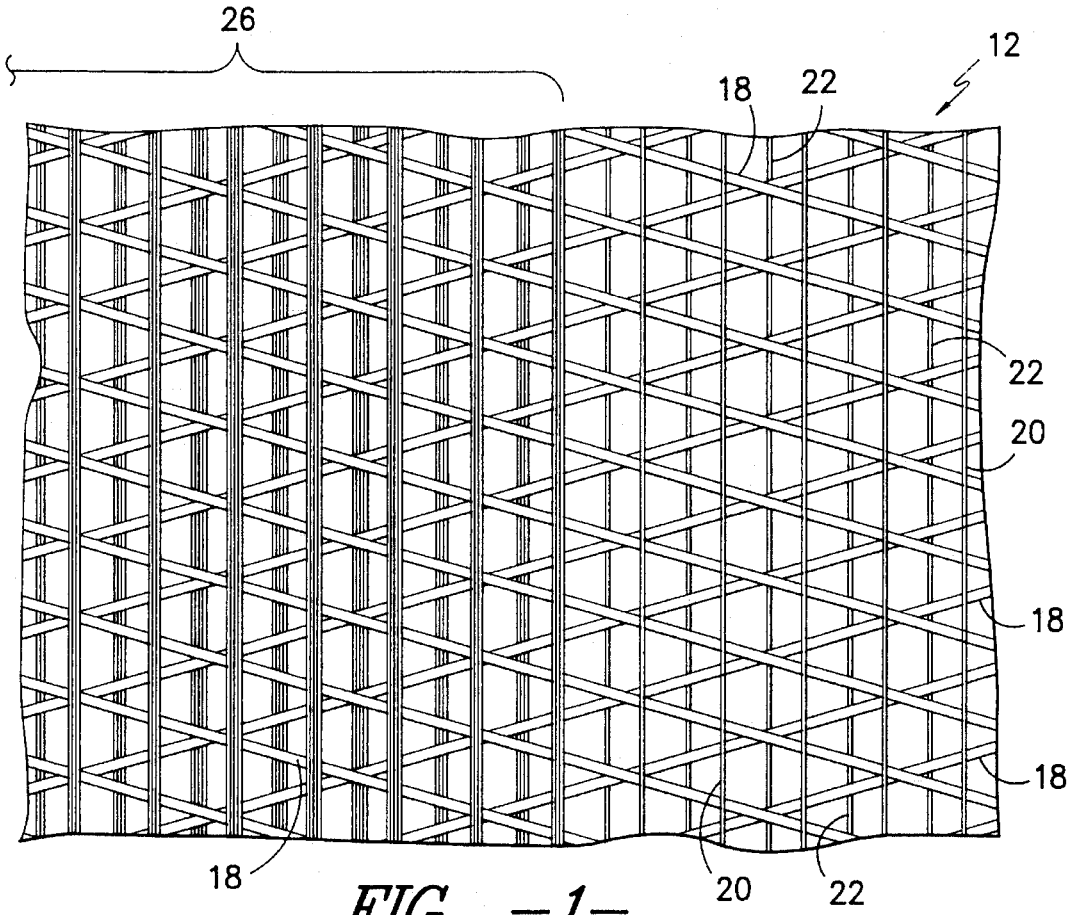
FIG. 1 is a top view of the scrim substrate used in the roofing material.
Figure 2:
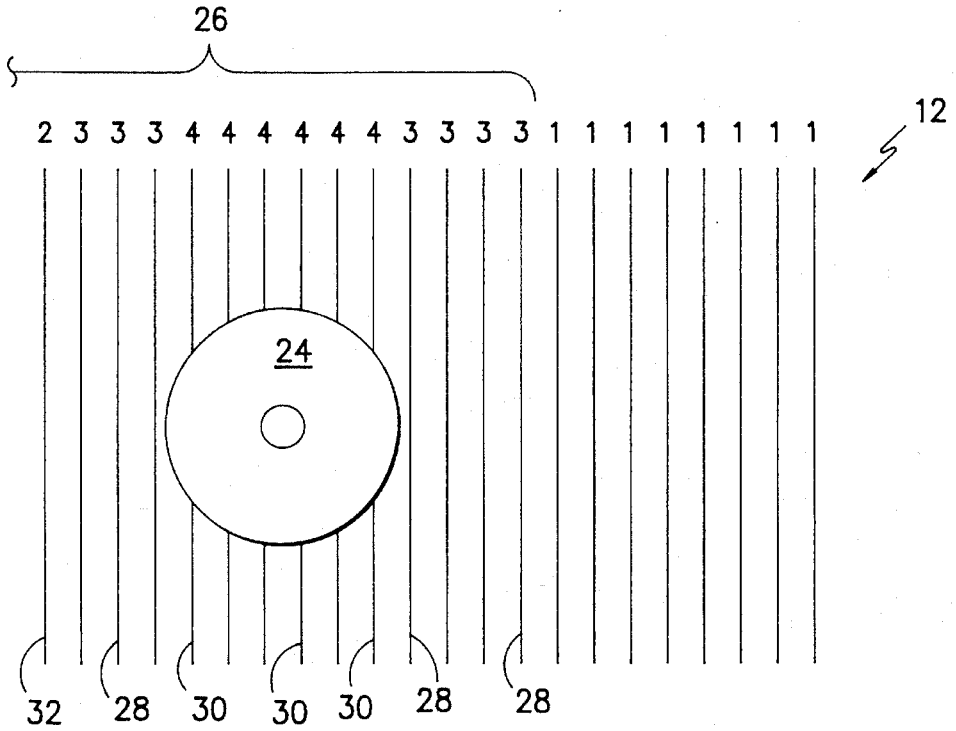
FIG. 2 is a schematic representation of the warp yarn pattern in the substrate of FIG. 1.

To strengthen the area of the roofing fabric 10 adjacent the outer edges thereof where the roofing connectors or nails 24 will be driven therethrough to secure the fabric to the sub-roofing the construction of the substrate 12 has been enhanced as shown in FIGS. 1 and 2.

Looking now to the area designated 26 which is a beefed-up selvage area and is located on both sides of the substrate 12 with only one area 26 being shown for purposes of explanation. As with the warp yarns 20 and 22, the beefed-up selvage warp yarns are alternated above and below the fill yarns 18. Basically the selvage area 26 is strengthened by running more than one yarn through the same reed so that there are multiple yarns adjacent one another. As indicated in FIGS. 1 and 2 as you proceed from the body of the fabric 12 outward towards the selvage the number of yarns increase from 3 forming selvage yarn 28 to 4 forming the selvage yarns 30 where the roofing connection or tacks 24 will be located. Then the number of yarns decrease to 3 again to form yarn 28 and is then reduced to 2 yarns to form the yarn 32 adjacent the outside selvage yarn (not shown). As can be seen, the selvage area 26 has the largest number of yarns therein since it is the area of impact when the fabric 10 is attached to the sub-roofing by the tacks 24.

As described above it can readily be seen that the increased number of selvage yarns in each of the selvage yarns provides additional strength to the roofing fabric 10 without reducing the flexibility thereof when laying it down on a flat roof. Also the increased number of yarns in the area where the fabric 10 is tacked down on sub-roofing reduces the possibility of tearing or ripping when being installed or upon the application of high winds during a wind or rainstorm.

Although the preferred embodiment of the invention has been described it is contemplated that changes may be made within the scope of the invention and it is desired that the invention be limited only by the scope of the claims.

We claim:

1. A roofing fabric comprising:

A triaxially wound scrim substrate having a central area and selvage areas along opposing edges thereof and a PVC material connected to the top and bottom of said scrim substrate, wherein the central area of the scrim comprises individual warp yarns spaced apart from one another and the selvage areas comprise a plurality of groups of warp yarns with the warp yarns in each group abutting one another and the groups of warp yarns spaced apart from one another.

2. A roofing fabric comprising:

A triaxially wound scrim substrate having a central area and selvage areas along opposing edges thereof and a PVC material connected to the top and bottom of said scrim substrate, wherein the central area of the scrim comprises individual warp yarns spaced apart from one another and the selvage areas comprise a plurality of groups of warp yarns with the warp yarns in each group being closely adjacent each other and the groups of warp yarns spaced apart from one another, wherein the number of selvage yarns in each group increases from the body of the substrate towards the selvage areas and then decreases in number to provide an area having a maximum number of warp yarns in the selvage areas of the scrim for the penetration of the roofing tack.

3. The fabric of claim 2 wherein the number of warp yarns in each group of warp yarns increases from one to three to a maximum of four and then decreases to two from the body of the substrate towards the selvage areas.

* * * * *